United States Patent [19]

Siewert

[11] 4,361,915

[45] Dec. 7, 1982

[54] SHOWER CURTAIN ASSEMBLY

[76] Inventor: Barry L. Siewert, 6411 Waltonway, Tampa, Fla. 33610

[21] Appl. No.: 222,295

[22] Filed: Jan. 5, 1981

[51] Int. Cl.[3] ..... A47K 3/22; A47K 3/08; A47K 3/14

[52] U.S. Cl. ..... 4/608; 4/609; 4/610; 4/558

[58] Field of Search ..... 4/607, 558, 608, 609, 4/610

[56] References Cited

U.S. PATENT DOCUMENTS

| | | | |
|---|---|---|---|
| 2,771,945 | 11/1956 | Wittrup | 4/608 X |
| 2,774,973 | 12/1956 | Aarnio | 4/608 |
| 3,418,665 | 12/1968 | Long | 4/610 |
| 3,639,919 | 2/1972 | White | 4/608 |
| 3,879,806 | 4/1975 | Armstrong | 4/608 X |
| 4,126,172 | 11/1978 | Faragher, Jr. | 4/608 X |
| 4,152,790 | 5/1979 | Obradovits | 4/608 X |

*Primary Examiner*—Henry K. Artis
*Attorney, Agent, or Firm*—Alfred E. Wilson

[57] ABSTRACT

An improved shower curtain assembly is disclosed for use as an enclosure for shower stalls and bath tub and shower combinations. A pair of closely spaced parallel outer and inner shower rods are installed in a spanning relation to the entrance opening into the stall or tub with a first curtain suspended from the outer rod and a second curtain suspended from the inner rod. One opposed pair of vertical edges of the curtains are secured to respective walls in a water tight relation thereto, and in a first form, the bottom edge of the outer curtain is preferably weighted against the top edge of the shower stall or bath tub outer rim. The outer curtain may be of a substantially reduced width relative to the inside curtain, which is slidably operable across the entire width of the enclosure opening in a conventional manner. It will be apparent that if desired an outer reduced width curtain may also be installed on the side of the opening adjacent the shower head, or a pair of full width curtains may be employed with one pair of opposed vertical edges thereof being secured in a watertight relation to respective adjacent walls.

4 Claims, 6 Drawing Figures

SHOWER CURTAIN ASSEMBLY

BACKGROUND OF THE PRESENT INVENTION

The present invention pertains to an improved shower curtain assembly. Conventional shower curtains generally hang loose along both sides of a shower or bath tub and shower enclosure often resulting in the leakage of a considerable amount of water outwardly onto the wall and floor of the bathroom. This condition obviously leads to a wip up job for someone and over a period of time to a considerable degree of water damage.

Therefore, the principal object of the present invention is to provide an inner and outer shower curtain assembly including opposed vertical edges with one opposed edge of each curtain sealed in a water tight relation along the vertical side walls of the enclosure.

A further object of the present invention is to provide means to prevent the leakage of water between the bottom edge of the curtain assembly and the outer bottom rim of the shower stall or a bath tub.

DETAILED DESCRIPTION OF A PREFERRED EMBODIMENT

Figure 1:
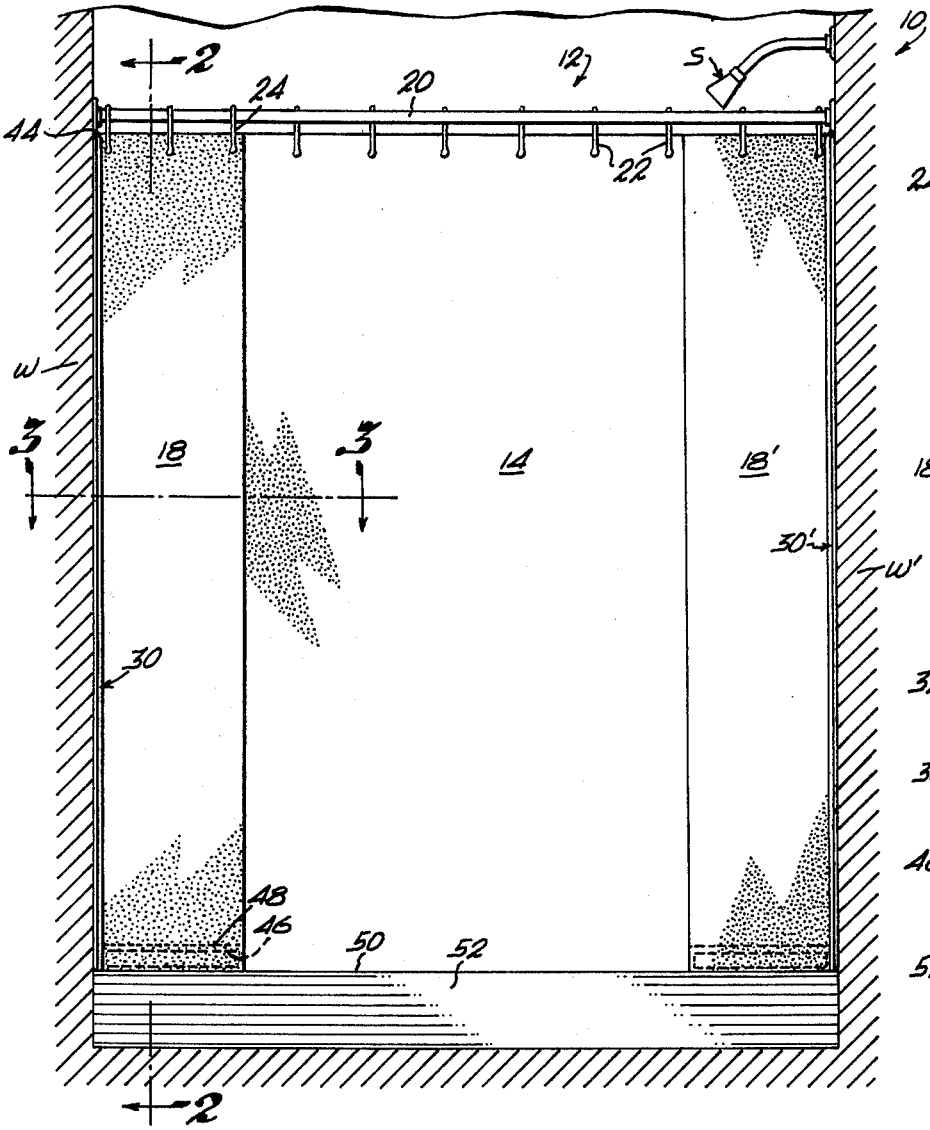
FIG. 1 is a front elevational view of a typical shower stall, provided with the shower curtain assembly of the present invention.

With reference to the drawings, and particularly to FIG. 1, a typical shower stall, indicated generally at 10, is provided with the shower curtain assembly 12 of the present invention. Assembly 12 includes an inner shower curtain 14, suspended from a first or inner shower rod 16, and an outer shower curtain 18, suspended from a second or outer shower rod 20.

With reference to the inner shower curtain 14, it is generally of a conventional size and design, being suspended from the first shower rod 16 on a plurality of spaced apart hangers 22 which are slidable along the rod 16 in a conventional manner, to permit the opening and closing of curtain 14 relative to the stall 10.

The outer shower curtain 18 is suspended from the second or outer shower rod 20 by similar hangers 24 and includes a thickened vertical outside edge 26 for captivated engagement in a vertical recess 28 in an anchor strip 30, secured to the wall W of the enclosure 10, opposite to the shower head installation S. Anchor strip 30 is secured to wall W by suitable anchor means such as screws 32 engaged through flange 34. The vertical recess 28 is defined by the vertical dome portion 36 of strip 30 which is slotted at 38 to accommodate the curtain 18.

The thickened vertical edge 26 may be formed by a head 40 extending through the vertical length of a hem 42 and the edge 36 is installed in the recess 28 by vertically sliding the beaded hem 42 downwardly thereinto from the open top end 44 thereof.

Figure 2:
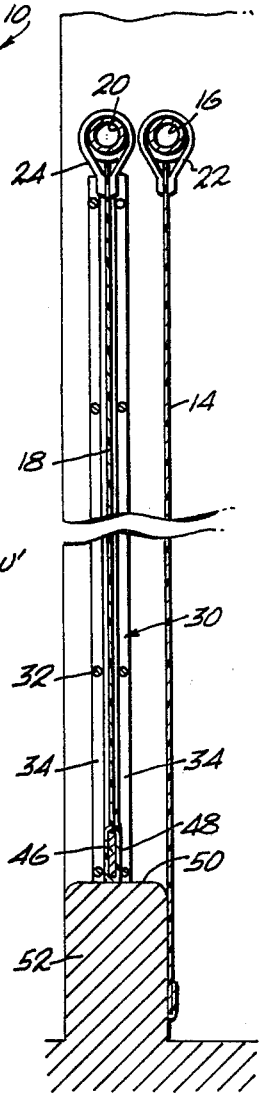
FIG. 2 is an enlarged fragmentary vertical sectional view taken along line 2—2 of FIG. 1.
Figure 3:
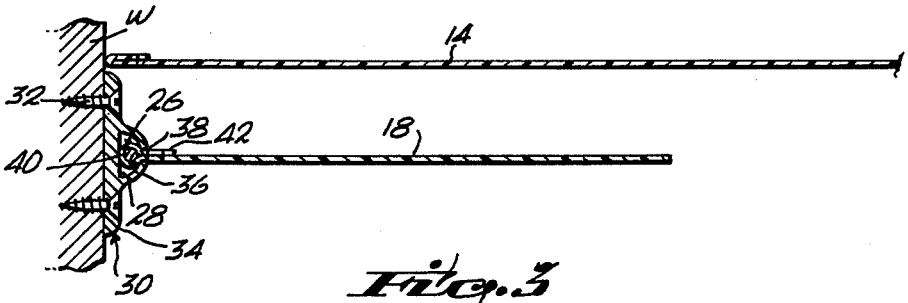
FIG. 3 is an enlarged horizontal cross sectional view taken along line 3—3 of FIG. 1.

A rigid weight 46, FIGS. 1 and 2 is captivated in a bottom hem 48 of curtain 18 to seat against the top edge 50 of the outer enclosure rim 52. Outer curtain 18 may be of a substantially reduced width, relative to inner curtain 14 in a preferred form, to the full width of curtain 14.

Curtain 18, as disclosed, is substantially reduced in width relative to curtain 14, and a second curtain 18', similar to curtain 18, may be similarly suspended from the opposed side of outer rod 20, and secured in a similar anchor strip 30', fixed to an opposed side wall W' of the stall 10.

Figure 4:
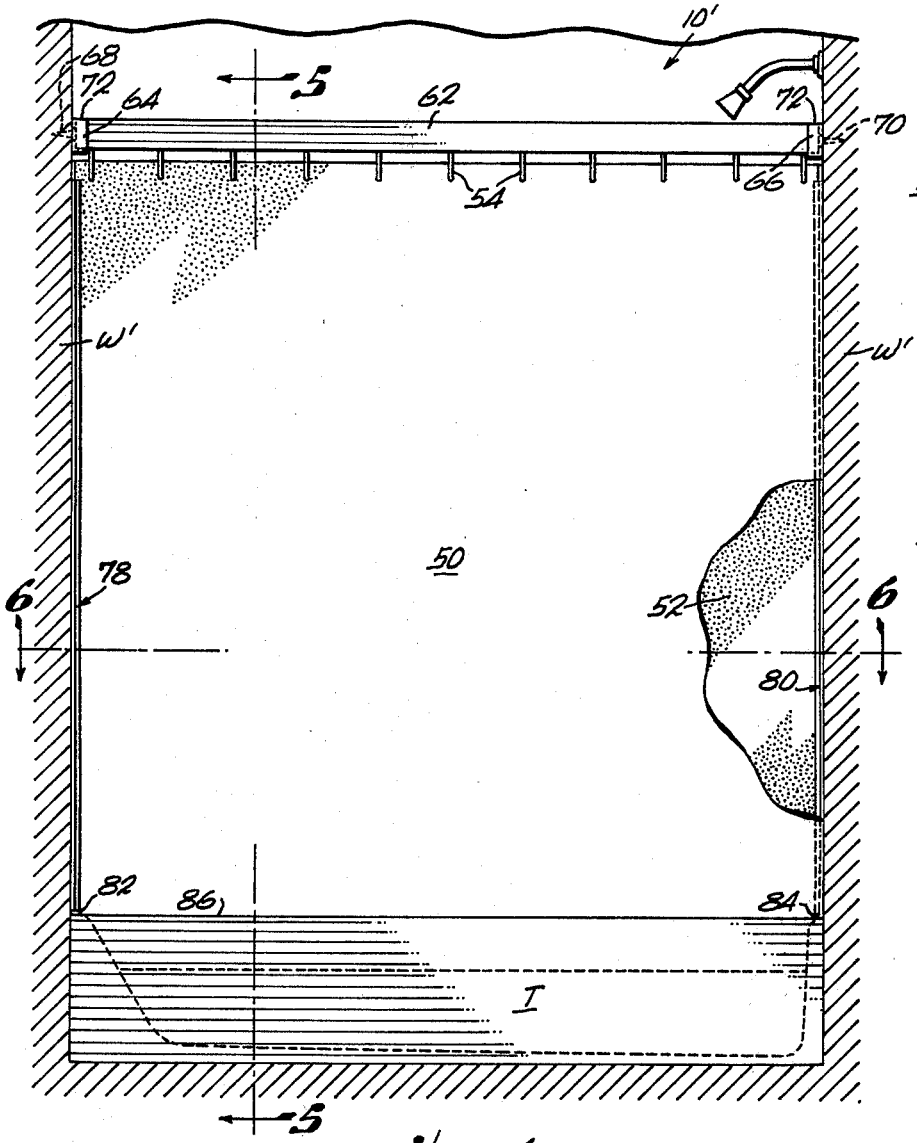
FIG. 4 is a front elevational view similar to FIG. 1, illustrating a second preferred form of the invention.
Figure 5:
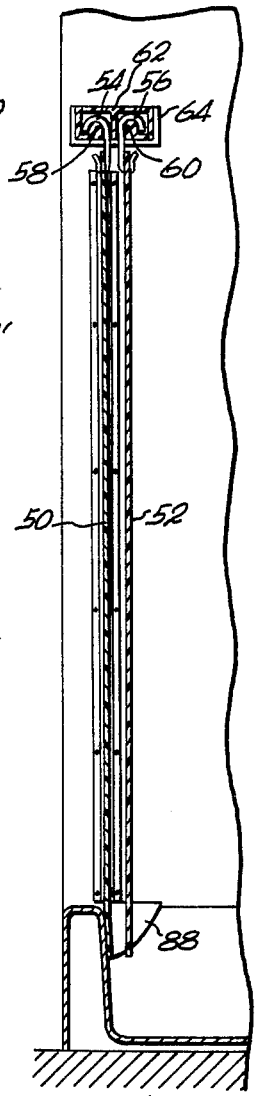
FIG. 5 is a vertical sectional view taken along line 5—5 of FIG. 4.
Figure 6:
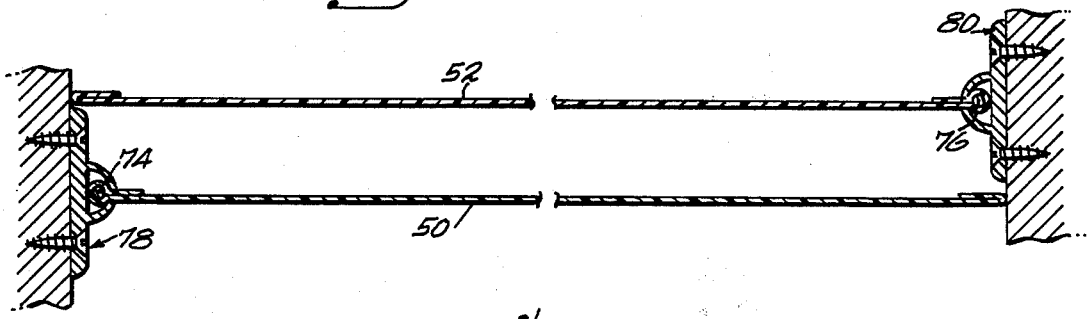
FIG. 6 is a substantially enlarged fragmentary sectional view taken along line 6—6 of FIG. 4.

FIGS. 4, 5 and 6 illustrate a second preferred form of my invention in which outer and inner shower curtains 50 and 52 are mounted by respective pluralities of hooks 54, 56 slidable on rods 58, 60 which may be similar to rods 16 and 20, or, as shown, may be in a molded or extruded form in an integral relation within a rail 62, seated within end brackets 64, 66, fixed by fastening means, such as screws 68, 70, to opposed side walls W'. End brackets 64, 66 have open tops as at 72, and the rail 62 is seated therein through the open tops 72. Hooks 54, 56 are slid into place on the respective rods 58, 60 prior to seating the rail 62 in brackets 64, 66.

Shower curtains 50 and 52 have opposed side edges which are beaded as at 74, 76, FIG. 6, as described relative to curtain 18, for sealed engagement in anchor strips 78, 80, similar to anchor strip 30. A bath tub T is illustrated in enclosure 10' and curtains 50, 52 are elongated in a manner so as to extend a distance downwardly into the tub T. Therefore, the anchor strips 78, 80 are foreshortened very slightly at 82, 84 relative to the top edge 86 of the tub T to permit the opposed corners of curtains 50, 52 to be turned inwardly and downwardly along the tub T as at 88, FIG. 5, to effect a secure water seal at the opposed corners.

While several preferred forms of the invention have been herein disclosed, it will be evident to those skilled in the art that various changes and modifications can be made therein without departing from the true spirit of the invention as defined in the appended claims.

I claim:

1. An improved shower curtain assembly for use as an enclosure for shower stalls and bath tub and shower combinations comprising, a pair of spaced apart parallel horizontally disposed shower rods installed in an upper spanning relation to an entrance opening into the shower stall or tub and shower combination, an outer shower curtain suspended from an outer rod of said pair and an inner shower curtain slidably suspended from an inner rod of said pair, means to secure a thickened vertical edge of said outer curtain formed on a side thereof in an opposed relation to the location of a conventional shower head installation to an existing wall of the entrance opening in a water tight relation thereto, and wherein said means to secure comprises a vertical strip fixed to the existing wall and defining an interior vertical recess along its vertical length to slidably receive said thickened vertical edge, and a slot reduced in width relative to said thickened edge, opening into said recess to permit sliding passage of said thickened end into said recess, and weight means secured in a hem in a bottom edge of said outer curtain for engagement with a top edge of an existing outer rim of the stall or bath tub.

2. The assembly as defined in claim 1 wherein said thickened vertical edge is defined by a bead disposed in a hem formed along said thickened vertical edge.

3. The assembly as defined in claim 1 wherein said outer shower curtain is of a substantially reduced width relative to said inner shower curtain, which spans said entrance opening.

4. The assembly as defined in claim 3 including a second reduced width outer shower curtain, slidably suspended on said outer rod, and including a thickened edge along a side thereof for engagement in a second vertical strip, fixed to an existing vertical wall on the side of the shower head installation.

* * * * *